United States Patent [19]

Zeiringer

[11] 4,089,706

[45] May 16, 1978

[54] METHOD OF PRODUCING FLINT

[75] Inventor: Hans Zeiringer, Kappel, Krappfeld, Austria

[73] Assignee: Treibacher Chemische Werke Aktiengesellschaft, Treibach, Austria

[21] Appl. No.: 706,826

[22] Filed: Jul. 19, 1976

[30] Foreign Application Priority Data

Jul. 21, 1975 Austria ..... 5636/75

[51] Int. Cl.[2] ..... B22D 25/00; C22C 23/00

[52] U.S. Cl. ..... 148/2; 75/152; 148/3

[58] Field of Search ..... 148/2, 3, 102; 75/152, 75/84; 72/253 R, 271, 700; 264/176 R, 234, 235, 332; 164/338, 348

[56] References Cited

U.S. PATENT DOCUMENTS

| | | | |
|---|---|---|---|
| 2,792,301 | 5/1957 | Bungardt | 75/152 |
| 3,236,633 | 2/1966 | Bungardt | 75/152 |
| 3,839,101 | 10/1974 | Doser | 148/102 |
| 3,839,102 | 10/1974 | Tawara et al. | 148/102 |

*Primary Examiner*—Walter R. Satterfield
*Attorney, Agent, or Firm*—Kurt Kelman

[57] ABSTRACT

Flint is produced from a mischmetal and iron melt by permitting the alloy melt to cool in a mold at a slow enough rate that, as the solidification point of the melt is approached, its temperature is maintained at 800°–600° C for at least 10 minutes. The alloy melt is subsequently extruded and the extrudate is subjected to a heat treatment at temperatures from 370°–470° C for ½ to 4 hours, the heat treatment being discontinued before the limit value of the thermodynamic equilibrium has been reached.

5 Claims, No Drawings

METHOD OF PRODUCING FLINT

The present invention relates to improvements in a method of producing flint from a melt of pyrophoric alloys of rare earth metals, such as mischmetal, and iron, which may also contain such metals as magnesium, aluminum, zinc, tin, titanium, copper and nickel. The resultant flints are easier to light by friction and have increased pyrophoric properties.

Flints from pyrophoric alloys of mischmetal and iron may be produced by an extrusion process such as described in U.S. Pats. Nos. 2,660,301, 2,792,301 or 3,256,633. In this process, cylindrical blocks of the alloy having a diameter of about 30 to 60 mm and a length of about 150 to 300 mm may be cast into molds preheated to a temperature of about 600° C to 700° C, the alloy melt having a temperature of about 1100° C. In the mold, the alloy melt cools in about 3 to 7 minutes to below the solidification point, the cylindrical alloy blocks being held for at least four minutes in the solidification range in which the melt is cooled down to 630° C. After the blocks have been extruded and the extrudate has been cut into the desired flint lengths, the flints are subjected to a heat treatment to increase the pyrophoric properties thereof until the structure has been fully stabilized and its lowest hardness has been reached. Heretofore and as disclosed in British patent No. 740,301, the heat treatment of flints after extrusion has preferably been carried out at a temperature of 350° to 450° C and, dependent on the temperature, for 5 to 24 hours to reach a limit value. This heat treatment produces a thermodynamically stable structure at which further treatment will not reduce the hardness of the structure.

Processes for improving the quality of flints have been proposed in German patent No. 1,063,509 and Austrian patent No. 235,030, according to which the cast blocks are subjected to heat treatment before extrusion.

However, none of the known processes has substantially improved the quality of the flints, particularly as far as increased ease in lighting them by friction is concerned, and experience has shown that extruded flints lack the pyrophoric qualities sought in modern lighters. Since such lighters are mass produced and have correspondingly poorer lighter mechanisms, they require flints of higher quality if they are to operate satisfactorily. The primary problem resides in achieving a sufficient number of ignitions of the flint even under low pressure of the ignition wheel, i.e. a low rotary speed of the wheel.

Contrary to the teaching of British patent No. 740,301, I have now found that flints of the highest quality are obtained when the heat treatment is interrupted before the limit value of thermodynamic equilibrium has been reached, the allow melt having been slowly cooled in the range of the solidification point before extrusion. It is desirable to prevent an increase in the hardness of the flints during cooling after the flints have been tempered, which is obtained by holding the cooling speed to 1° C to 2° C per minute.

Accordingly, in the method of this invention, the alloy melt cooling in the mold is slowed as the solidification point of the melt is approached sufficiently to maintain the alloy melt at a temperature from 800° to 600° C for a period of at least 10 minutes, the alloy melt is subsequently extruded and the extrudate is subjected to a heat treatment at temperatures from 370° to 470° C for one half hour to four hours. The heat treatment is discontinued before the limit value of the thermodynamic equilibrium has been reached. To obtain the superior results hereinbelow set forth in detail, it is essential to proceed with the slow cooling before extrusion and the heat treatment after extrusion in the indicated ranges.

Preferably, the cooling period in the temperature range of 770° to 610° C ranges from 10 to 150, most preferably from 45 to 60, minutes, and the heat treatment is carried out in the temperature range of 390° to 430° C for 1.5 to 2.5 hours.

While I am not bound by any theory, the favorable results obtained by the method of the invention may be explained by a synergistic effect of the combined special cooling and heat treatment producing a special structure of the extruded alloy, resulting in the physical parameters imparting a high quality to the produced flints.

Thorough investigation has shown that the desirable results are obtained by the use of the new method with all conventional pyrophoric alloys in their usual ranges of concentrations of alloy components and that the effect of the method exceeds the effects of differences in the alloy composition.

In addition to the pyrophoric property, expressed in percentages, the new concepts of rotary speed of ignition and actuating force are herein introduced as terms defining the quality of flints. The rotary speed of ignition is understood to be the rotary speed of the ignition wheel in a lighter required to produce a spark under a predetermined pressure on the flint. The actuating force (torque) is understood to be the force required to maintain a predetermined rotary speed of the ignition wheel under a predetermined pressure of the wheel on the flint. It has been found that these two parameters clearly define the quality of flints and that all flints which have a low rotary speed of ignition and a low actuating force are of correspondingly high quality. In addition, the pyrophoric property of the flints, which is measured as the percentage of ignitions in a conventional lighter, indicates the usefulness of the flints.

Significant improvements in the quality of flints have been found if, with a pyrophoric property of more than 90%, the rotary speed of ignition with the use of a predetermined ignition wheel (1 kp pressure on the flint) is reduced at least by 10, preferably more than 50, rpm and, simultaneously, the actuating force or torque (200 rpm and 1 kp pressure) is reduced by at least 10, preferably more than 40, cmg, compared with flints of the same alloy composition but produced by methods other than that of the present invention. In this respect, the presence of all three parameters is essential.

The following examples show that the quality of flints made by extrusion and heat treatment methods heretofore used can never be raised to the point where they meet the requirements in mass produced lighters while the flints made by the method of this invention show this quality to an outstanding extent.

The examples are given merely to illustrate the invention, without limiting the same, and the quality parameters are given therein for flints produced by the method of the present invention and, by way of comparison, for conventionally made flints. Different values are obtained for lower pressures, which indicate the improvement of the ignition properties even more clearly.

EXAMPLE 1

An alloy melt consisting of 76% mischmetal, 21% iron, 2.5% magnesium and 0.5% zinc, all percentages being by weight, and having a temperature of 1100° C was cast into a heatable iron mold to form cylindrical blocks of a diameter of 60 mm. The molten blocks cooled in the mold to a temperature of 770° C in 7½ minutes. The heating of the mold was then so controlled that cooling from 770° to 610° c took 48 minutes. Heating of the mold was then discontinued and the mold was later opened to permit cooling to room temperature relatively quickly and without further control. After the castings were extruded into strands and the strands were cut into individual flints, the flints were subjected to heat treatment at different temperatures and for different periods of time, as indicated in Table I which shows the quality indices of the flints.

EXAMPLE 2

The pyrophoric alloy having the composition and temperature of Example 1 was again cast into a heatable mold where it cooled to a temperature of 770° C in 6 minutes. Further cooling was then so controlled that the temperature was reduced to 610° C within 10 minutes. Further operating steps were identical with those of Example 1 and the quality indices of the produced flints are shown in Table I.

EXAMPLE 3

The melt of Example 1 was cast into a heatable mold and cooling to 770° C took 8 minutes, the mold then being heated so that further cooling to 610° C took another 150 minutes. Further treatment was again identical and the quality indices of the flints are shown in Table I.

EXAMPLE 4

For the sake of comparison, the pyrophoric alloy melt of Example 1 was cast in a conventional manner at a temperature of 1100° C into a mold preheated to a temperature of 700° C. The entire cooling period down to a temperature of 610° C was 7 minutes. After the castings were extruded, the flints were tempered according to Example 1. The quality indices of the flints obtained in this manner are shown in Table I.

Table I

| Ex. Cooling period of the casting in min. from 770° C to 610° C | Heat Treatment ° C | Macro-hardness HB in kg/mm² | Rotary speed rpm at 10 kp pressure | Torque in cmg, 200 rpm at 1 kp pressure | Pyrophoric property in% |
|---|---|---|---|---|---|
| 1 + 48 | 2 h at 360° | 135 | 205 | 208 | 84 |
| | 2 h at 400° | 124 | 180 | 210 | 98 |
| | 2 h at 440° | 116 | 185 | 225 | 95 |
| + | 2 h at 480° | 104 | 195 | 250 | 89 |
| | 1 h at 460° | 118 | 182 | 215 | 95 |
| | ½ h at 470° | 124 | 190 | 215 | 92 |
| | 4 h at 380° | 126 | 185 | 210 | 95 |
| + | 10 h at 400° | 103 | 195 | 255 | 88 |

Table I-continued

| Ex. Cooling period of the casting in min. from 770° C to 610° C | Heat Treatment ° C | Macro-hardness HB in kg/mm² | Rotary speed rpm at 10 kp pressure | Torque in cmg, 200 rpm at 1 kp pressure | Pyrophoric property in% |
|---|---|---|---|---|---|
| 2 + 10 | 2 h at 360° | 142 | 270 | 255 | 81 |
| | 2 h at 400° | 128 | 270 | 255 | 90 |
| | 2 h at 440° | 125 | 250 | 260 | 93 |
| + | 2 h at 480° | 120 | 265 | 280 | 85 |
| | 1 h at 460° | 125 | 250 | 260 | 91 |
| | ½ h at 470° | 128 | 255 | 260 | 90 |
| | 4 h at 380° | 122 | 250 | 260 | 91 |
| + | 10 h at 440° | 118 | 270 | 285 | 87 |
| 3 + 150 | 2 h at 360° | 128 | 170 | 205 | 89 |
| | 2 h at 400° | 119 | 172 | 212 | 97 |
| | 2 h at 440° | 109 | 185 | 220 | 93 |
| + | 2 h at 480° | 98 | 195 | 245 | 82 |
| | ½ h at 470° | 108 | 190 | 215 | 94 |
| | 1 h at 460° | 106 | 188 | 221 | 91 |
| | 4 h at 380° | 118 | 182 | 215 | 96 |
| + | 10 h at 410° | 101 | 180 | 240 | 85 |
| 4 + below 7 | 2 h at 360° | 142 | 310 | 280 | 78 |
| + | 2 h at 400° | 130 | 305 | 295 | 84 |
| + | 2 h at 440° | 122 | 310 | 320 | 93 |
| + | 2 h at 480° | 116 | 300 | 322 | 92 |
| + | ½ h at 470° | 118 | 300 | 320 | 90 |
| + | 1 h at 460° | 121 | 300 | 321 | 94 |
| + | 4 h at 380° | 126 | 305 | 300 | 89 |
| + | 10 h at 440° | 118 | 310 | 325 | 94 |

To show the results of the invention more clearly, flints were also treated in ranges outside the invention. These comparative flints are indicated in the table by +.

The Table shows that the ignition qualities of flints produced by the method of this invention have been considerably improved, particularly as far as their ignition under relatively low pressure and low rotary speeds of the ignition wheel is concerned. This and their easy abrasion impart to the flints superior usefulness in all lighters, particularly such as are produced under modern mass production techniques.

What is claimed is:

1. A method of producing flint from a melt of a pyrophoric alloy of rare earth metals and iron, which comprises the steps of casting the alloy melt into a mold, permitting the melt to cool in the mold, slowing the cooling as the solidification point of the melt is approached sufficiently to maintain the alloy melt at a temperature from 770° to 610° C for a period of at least ten minutes, subsequently extruding the alloy melt and subjecting the extrudate to a heat treatment at temperatures from 370° to 470° C for one half hour to four hours, the heat treatment being discontinued before the limit value of the thermodynamic equilibrium has been reached and the combined cooling and heat treatments being selected to attain a pyrophoric property of at least 90%, as defined herein.

2. The method of claim 1, wherein the alloy of rare earth metals is mischmetal.

3. The method of claim 1, wherein the alloy of rare earth metals and iron also contains at least one of the metals selected from the group consisting of magnesium, aluminum, zinc, tin, titanium copper and nickel.

4. The method of claim 1, wherein the cooling period ranges from 10 to 150 minutes.

5. The method of claim 4, wherein the cooling period ranges from 45 to 60 minutes and the heat treatment is carried out in the temperature range of 390° C to 430° C for 1.5 to 2.5 hours.

* * * * *